US005281936A

United States Patent [19]

Ciezarek

[11] Patent Number: 5,281,936

[45] Date of Patent: Jan. 25, 1994

[54] MICROWAVE SWITCH

[75] Inventor: Krzysztof J. Ciezarek, San Jose, Calif.

[73] Assignee: Teledyne Industries, Inc., Los Angeles, Calif.

[21] Appl. No.: 891,592

[22] Filed: Jun. 1, 1992

[51] Int. Cl.[5] ..... H01H 53/00

[52] U.S. Cl. ..... 335/4; 333/103

[58] Field of Search ..... 335/4, 5, 104, 105, 335/106; 333/104-109, 103

[56] References Cited

U.S. PATENT DOCUMENTS

| | | | |
|---|---|---|---|
| 3,487,342 | 12/1969 | Gibson | 335/4 |
| 4,298,847 | 11/1981 | Hoffman | 335/5 |
| 4,633,118 | 12/1986 | Kosugi | 200/181 |
| 4,697,056 | 9/1987 | Hoffman | 335/105 |
| 5,065,125 | 11/1991 | Thomson et al. | 335/5 |

*Primary Examiner*—Lincoln Donovan
*Attorney, Agent, or Firm*—Skjerven, Merrill, MacPherson, Franklin & Friel

[57] ABSTRACT

A microwave switch provides a random selection drive for selectively one or more reeds which are movable by an actuator to electrically bridge across a pair or pairs of microwave connector contacts. The preferred embodiment of the drive employs at least two actuators, normally three, in the form of cantilevered leaf springs, which are mounted at different levels or parallel plane in a drive body. Respective ones of the actuators are displaced by the rocking action of a wobble plate or rocker movable by repelling and attraction forces provided by a series of spaced magnetic coils spacedly mounted on the drive body. Integral pusher arms of various lengths extend from the bottom of the wobble plate with their distal ends terminating variously at the same different levels in which the leaf springs extend. Rocking of the wobble plate to one of three selected positions displaces a particular leaf spring which in turn depresses one or two selected reeds into bridging contact with a pair or pairs of selected microwave connector contacts. An indicator function is provided with respect to each leaf spring which indicates which pair(s) of the microwave connector contacts represent a closed RF path.

20 Claims, 9 Drawing Sheets

MICROWAVE SWITCH

FIELD OF THE INVENTION

This invention relates to microwave switches. More particularly, it relates to a drive mechanism for the connection of various pairs of a typical array of six movable radio frequency (RF) coaxial connectors of a so-called T-switch.

BACKGROUND OF THE INVENTION

Heretofore, contacts between microwave coaxial connectors generally have been made by pushing on a pushrod, spring-return connected to an electrically-conductive reed or switch blade which positions the reed in a position bridging across conductive center pins of the connector. Typically the conductive parts are constructed of gold-plated beryllium copper which provides very good solderability, wear and RF qualities. Switching of the positions of a mechanical switch actuator can take place both in the power-off and power-on conditions. The pushrods can be actuated individually by actuating coils above each pushrod or a rotary drive may be used to sequence through an angular travel to depress each of the array of pushrods one-by-one. Single-pole-double throw (SPDT) coaxial switches have been employed to alter the path of an incoming signal to one or the other of two outputs or to select one input for an output. Particularly, current T-switches for operating a 6-reed standard arrangement or array 10 of reeds shown in FIG. 1 utilize a series of dielectric pushrods 11, each attached to a series of reeds 12*a* and 12*b*. Depression of one pushrod moves the reed 12*a* to electrically bridge across RF conductor contacts 14 and 15 and depression of another pushrod moves reed 12*b* to bridge across contacts 14 and 16, when the reeds are depressed by a force vector against a particular pushrod 11. FIG. 1 shows short reed 12*a* and long reed 12*b* in a switch open condition, while reed 12*c* and 12*d* are in a switch closed condition between contacts 14 and 17 and 15 and 16, respectively. Return springs 18 return the pushrods and reeds to their normal "unpushed" position upon release of the force vector. In the open stroke the reed is forced against the top of the cavity (FIG. 3). This effectively presents a waveguide below cut off frequency.

FIGS. 2 and 3 illustrate a one-directional rotary drive 20 having coils 21 with cores 19 which are indexed to a desired pushrod 18 and move about shaft 22.

The reed actuator is based on interaction between two layers of magnets. One layer 23 consists of six magnets attached to dielectric pushrods 18 placed in the middle of each reed. All magnets are magnetized parallel to the direction of reed movement and have the same polarity.

The second layer 24 comprises another set of six magnets contained in the lower portion of a rotating disk or armature 29. The axis of magnetization for these magnets is the same as for the magnets in the first layer. However, four of these magnets are placed to attract the magnets from the first layer, and two of the magnets, 180° apart, are of opposite polarity. These two magnets repel and force a pair of reeds to make contact. At the same time, the rest of the reeds (not shown in the Fig.) are grounded to the top of the RF body as a result of attraction between the magnets.

The rotating disk has six stable positions as a result of the magnets' interaction with cores which latch the disk every 60°. During a full turn of the disk, each position of the switch is chosen twice. As shown in FIGS. 4A–4F, six positions of the disk actually represent three unique RF contact arrangements. Generally, the reed actuator assures proper reed arrangement for all three positions of the switch and latches the reeds in each position.

The rotating actuator or armature is based on electromagnetic interaction between a layer of six magnets 24*a* and six drive coils. This layer of magnets is contained in the upper rotating disk and has the same axis of magnetization as other magnets in the reed actuator discussed previously. However, those upper magnets are polarized alternatively so that every other magnet has the same polarity. There is a magnetic shielding plate 24*c* in the middle of the rotating actuator to isolate the magnetic forces from the upper and lower layers of magnets. To be able to change the position of the switch, it is necessary to rotate the disk. To accomplish this function, a multicoil drive approach has been used.

The drive consists of six coils 21 which are wound directly on ferromagnetic cores 19 and attached to a common ferromagnetic magnet plate 27. The coils are equally spaced on the same diameter as the magnets in the rotating disk 23, but the whole coil assembly is offset about 15° from the position of the magnets. To obtain all three positions, shown in FIGS. 4A–4F, it is necessary to energize the coils with three separate voltage pulses. Each pulse shall have an opposite voltage polarity from the preceding pulse. The drive mechanism will latch the 3-switching positions sequentially and is unable to select any one of three switching positions randomly.

As can be envisioned, if one desires to rotate from the approximately one o'clock position (FIG. 2) to the seven o'clock position, one must first pass by two intervening positions. This takes extra time, travel distance and extra energy which may be a premium, particularly in, for example, a space application. On the top of magnet plate 27 there is placed a printed circuit board (PCB) with electronic control elements (not shown) and is shown removed in FIG. 3. FIG. 4 illustrates six positions A-F of this prior art rotary drive, particularly showing the six types of connections made possibly by six reeds between the various contacts 14, 15, 16 and 17.

SUMMARY OF THE INVENTION

In order to save time, distance travelled and energy used, there has been a need for a "random selection" drive as distinguished from the prior art "sequential" drive discussed above. A random selection drive is provided for selectively actuating one or more than one reed, e.g. two reeds, so that the reed(s) quickly, and with minimum travel and energy, bridge over a respective pair of microwave connector contacts of an array of such contacts, typically six in number. At least two actuators preferably in the form of cantilevered leaf springs, typically three in number, are mounted at different levels or parallel planes relative to the drive body. Means for displacing the leaf springs are provided, typically include a wobble plate having integral depending pusher arms of various lengths. The distal ends of the pusher arms terminate juxtaposed to a respective leaf spring in the same particular parallel neutral plane as the leaf spring. The pusher arms extend from the obverse side of the wobble plate facing the leaf springs. When the wobble plate is rocked by a repelling or attraction forces provided by a series of spaced magnetic coils mounted on the drive body and spaced from a reverse side of the wobble plate, one or two of the leaf springs are displaced to push a particular reed(s) into bridging contact with a pair(s) of the array of microwave connector contacts.

The T-switch random selection drive has three drive sections. Each section consists of one coil, one core and one permanent magnet. A magnet plate physically holds the three sections together at a spacing of 120° from each other. A threaded stub links the drive assembly to the rocker assembly. This threaded stub also provides axial adjustment between the drive and rocker. The terms "rocker" and "wobble plate" are used interchangeably herein. The T-switch rocker assembly is a three-arm, "Y" shaped mechanism. In the center of the rocker a stainless steel ball is captivated between a triangle plate and a "Y" shaped pusher plate. The ball joint serves as an effective angular-pivot for the "Y" shaped rocker. Attached to the rocker are three pusher arms. Each pusher arm has a unique length that activates the corresponding actuator or leaf spring.

The T-switch has three identical actuator assemblies. Each assembly compresses a "T" shaped actuator, dual leaf spring and a mounting block. Three actuator assemblies are mounted evenly 120° apart on the top of the RF section. They are mounted in three different levels or parallel planes relative to the drive body. The different levels enable the three "T" shaped actuators to interact with their respective pusher arms without interfering with each other. Each actuator assembly is in line with each one of the three rocker arms and the coil-magnet drive sections.

When the T-switch receives a switching command, the corresponding coil-magnet section is energized. The energized coil or coils causes the rocker assembly to change position in such a way that a "closed" magnetic path repels the rocker away from the drive and an "open" magnetic path (or two "open" paths) attract the rocker towards the drive section. Thus, the rocker assembly is in pivoting motion. Because the T-switch requires the rocker assembly to pivot in three different axes, a ball joint construction is provided and is a most effective pivot mechanism to provide such functions.

Dependent on the rocker particular pivoting motion, the pusher arms of the rocker assembly activate their respective "T" actuators. One pusher will press the "T" actuator which, in turn, presses a pushrod(s) and a reed(s) against a pair of RF inner conductors to form two "closed" RF paths. The other two pusher arms will release two "T" actuators and, therefore, open four RF paths. In the actual switching operation, one actuator presses a pair of RF conductors to close two "open" RF paths. The second actuator releases a pair of RF conductors to open two "closed" RF paths, while the third actuator remains in an "open" position. The indicator function of the "T" switch is realized by a stationary contact and movable "T" actuator. As an actuator is pressed down by the rocker/pusher arm, the "T" actuator makes contact with the stationary contact to indicate a pair of "closed" RF paths. At the same time, the other two "T" actuators move away from the stationary contacts to indicate four "open" RF paths. All interaction and angular rocking motions among three switching positions are transferred into a common joint formed by the ball pivot mechanism.

While shown with a T-switch array of reeds the invention can be utilized on other types of multi-position switches. Further, the switch including the wobble plate movement can be operated by conventional circuitry in a sequential mode of operation where a reed or reeds is activated sequentially rather than randomly.

The wobble plate/rocker including the ball joint of the present invention eliminates complex mechanical linkages by providing in a preferred embodiment a series of simple leaf springs at various levels and actuated by the rocking movement of the wobble plate. The result is a T-switch of extremely light-weight (120 gram, max.), small size and volume (3.64 cm×3.64 cm×6.42 max.), a minimum number (10) of moving parts and assemblies and of expected high reliability, durability and long life (−1,000,000 operations).

DETAILED DESCRIPTION OF THE DRAWINGS

Figure 5:
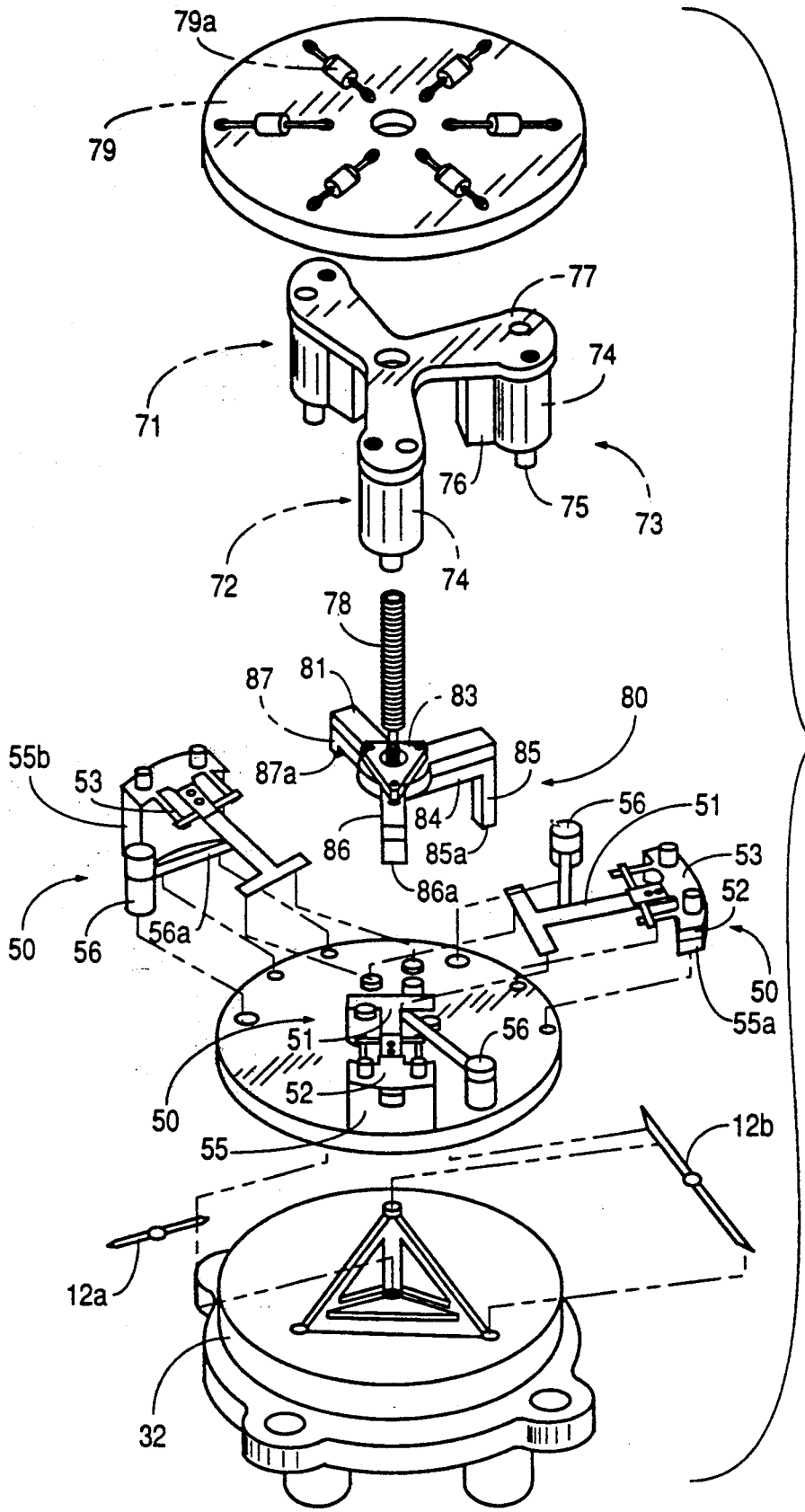
FIG. 5 is an exploded perspective view of the random selection drive assembly.

As seen in FIG. 5 the T-switch random selection 70 drive has three drive sections 71, 72 and 73. Each section comprises one coil 74, one core 75 and one permanent magnet 76. Instead of three separate magnets, one cylindrical magnet positioned in a magnetic path within the three coils at the center axis of the three coil array, with a hole in the center, can be employed. A magnet plate 77 physically holds the three sections together at a spacing of 120° apart from each other. A threaded stub 78 links the drive assembly to the rocker assembly 80. This threaded stub also provides axial adjustment between the drive and rocker. The T-switch rocker assembly in one embodiment is a three-arm, "Y" shaped mechanism 81. In the center of the rocker a stainless steel ball 82 is captivated between a triangle plate 83 and a "Y" shaped pusher plate 84. The ball joint serves as an effective angular-pivot for the "Y" shaped rocker 81. Attached to the rocker are three pusher arms 85, 86 and 87. Each pusher arm has a unique length with distal ends 85*a*, 86*a*, 87*a* that activate a corresponding actuator or leaf spring 51. A printed circuit board (PCB) 79 is placed on the top of the drive. Suppression diodes 79*a* and control diodes are mounted on the PCB outer surface.

Figure 7:
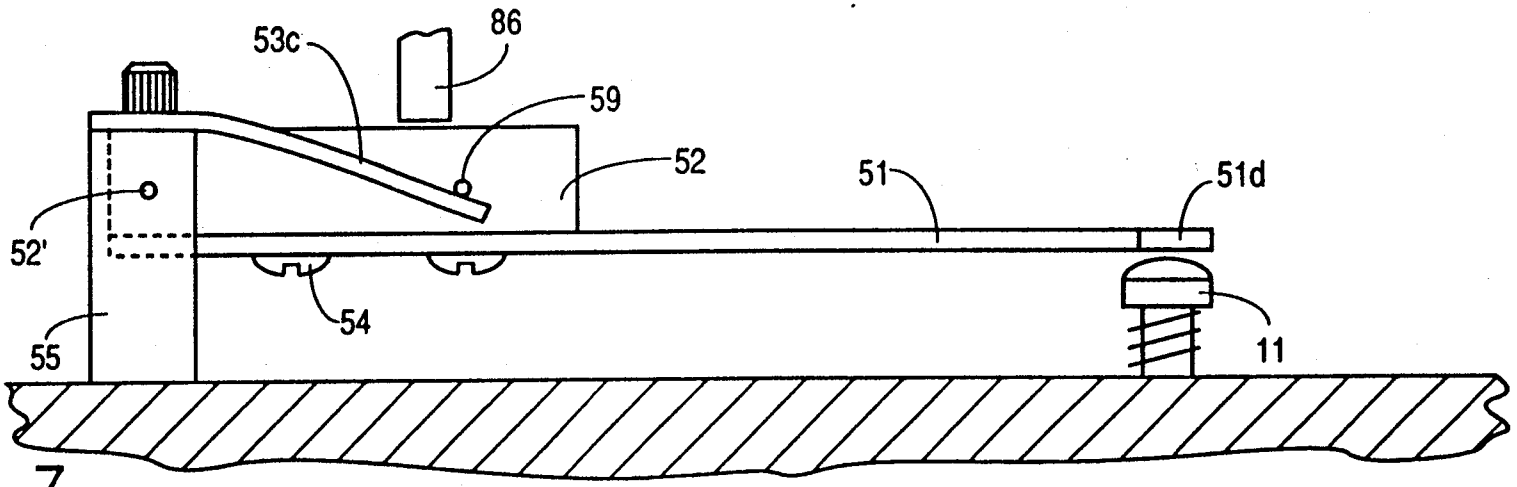
FIG. 7 is a detailed side view of an actuator in neutral position.

The T-switch has three identical actuator assemblies 50. Each assembly comprises a "T" shaped actuator 51 dual leaf spring 53 and a mounting block 52 from which each actuator leaf spring is cantilevered mounted. The T-shaped actuator is mounted to the mounting block 52 by means of screws 54 (FIG. 7). Each of the blocks 52 are pivoted in a split U-shaped pedestal 55 of various heights so that the respective actuators 51 are mounted at a different level corresponding to the level of the distal ends 85*a*, 86*a* and 87*a* of the pusher arms. Thus the longest pusher arm 85 reaches the actuator on the shortest pedestal 55*a* and the shortest pusher arm 87 reaches the actuator on the highest pedestal 55*b*. Indicator assemblies 56 are offset from assemblies 50. An indicator contact 56*a* is spacedly located under the T-shaped actuator which when depressed makes contact with contact 56*a*.

Figure 6:
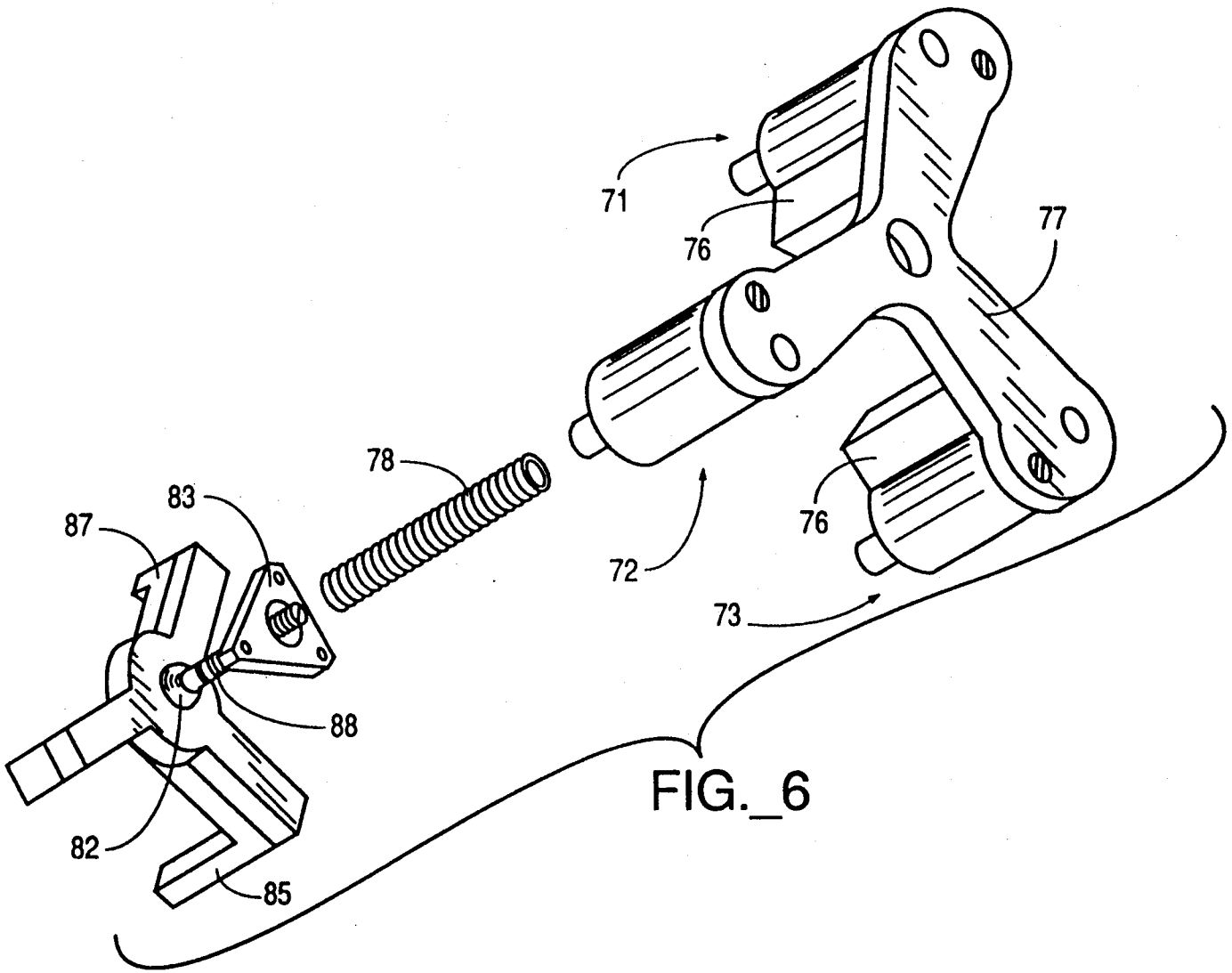
FIG. 6 is an exploded view showing the drive and rocker assembly.

FIG. 6 shows the ball joint in more detail. An adjusting means 88 is provided in the form of a screw with slotted head which can be screw driver rotated to adjust the wobble plate/rocker down to give a final adjustment of the spacing/angularity of the rocker. Angular movement can be adjusted to provide the required pressure by the pusher arms onto the actuators which is further transferred into contact forces.

Figure 8:
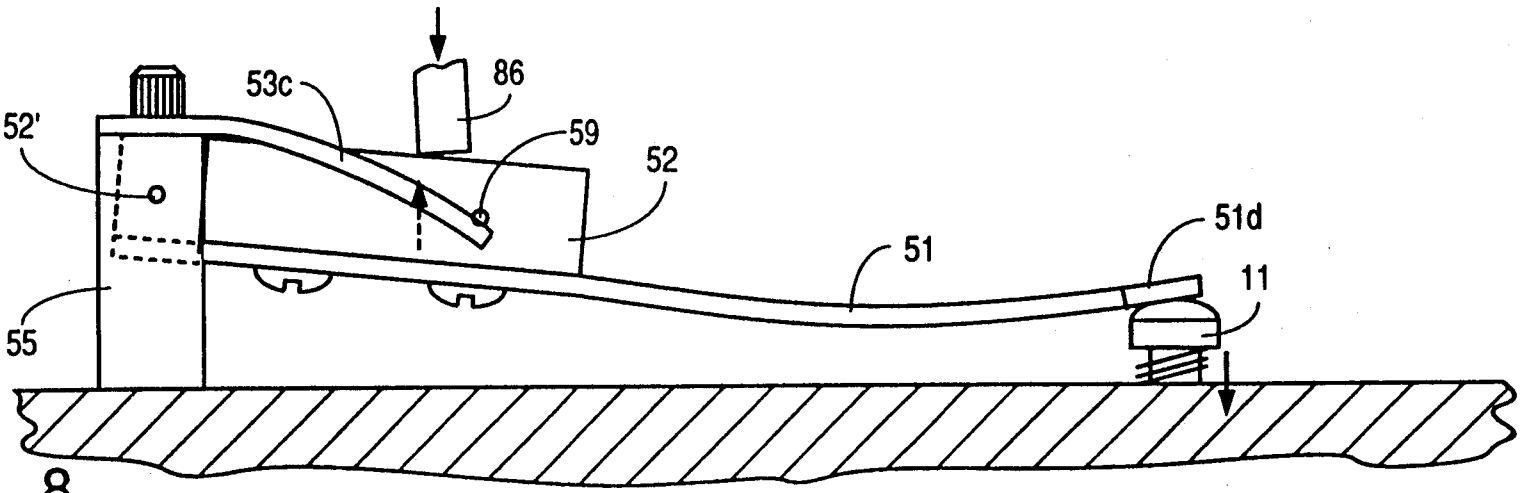
FIG. 8 is a detailed side view of the actuator in displaced actuated position

The position and motion of the actuator/leaf spring 51 is seen in FIGS. 7 and 8. The T-shaped actuator 51 is attached by screws 54 to block 52 extending from pedestal 55. One of double leaf spring arms 53*c* (and 53*a* on the reverse side of block 52) is positioned under a pin 59 extending laterally from block 52. Block 52 is pivoted at pin 52' to pedestal 55 and held (FIG. 6) at a neutral position as seen in FIG. 7 by dual leaf spring 53. In this position the distal end 51*d* is poised above and spaced from pushrod 11. When the wobble plate is rocked as shown in FIG. 8 so that pusher arm 86 is forced against block 52 (indicated by the down arrow), the block 52 pivots about pin 52' displacing the leaf spring 51 downwardly so that the distal end 51*d* (or other portion of the leaf spring if a differently shaped actuator is employed) depresses push rod down (down full arrows) to in turn depresses a reed. At the same time the dual leaf spring arms 53*a* and 53*c* are in tension with stored energy (dashed UP arrow) which, when the pusher arm force is removed (by a reorientation of the wobble plate), returns the actuator/leaf spring 51 to the neutral position of FIG. 7. Instead of the assembly shown in FIGS. 7 and 8, a simpler design may be employed in the case where a high level of resistance to vibration is not required. In this case the T-shaped actuator can be fixed at one end to the top of the pedestal and the dual leaf spring and mounting block not used.

Figure 1:
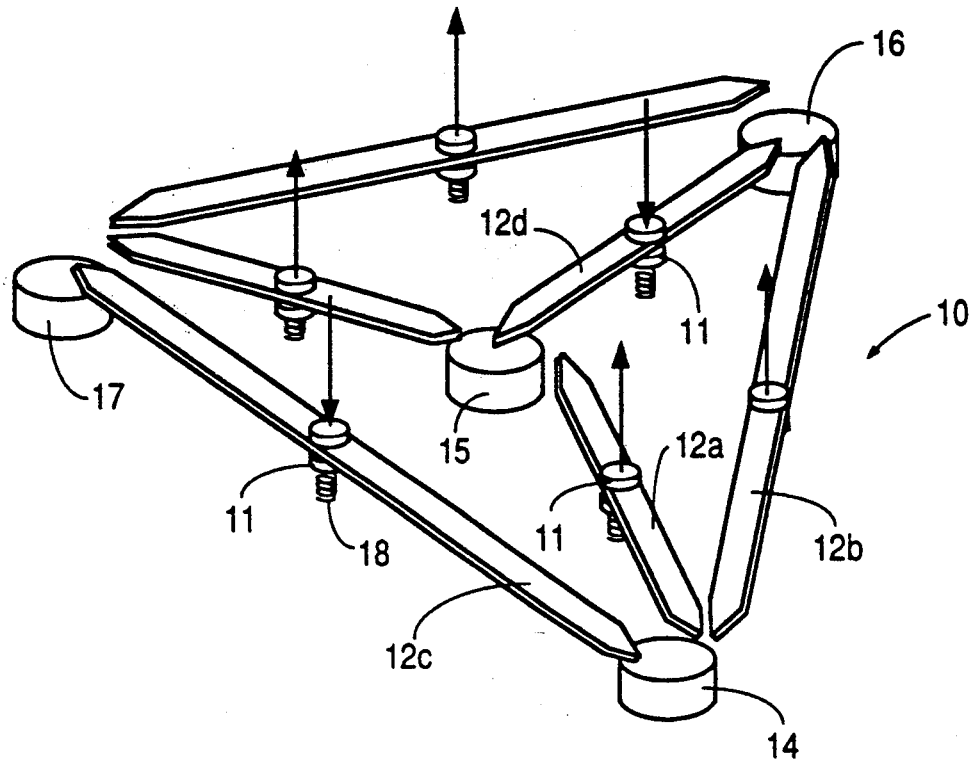
FIG. 1 (PRIOR ART)
FIG. 1 illustrates a prior art RF conductor assembly.
Figure 2:
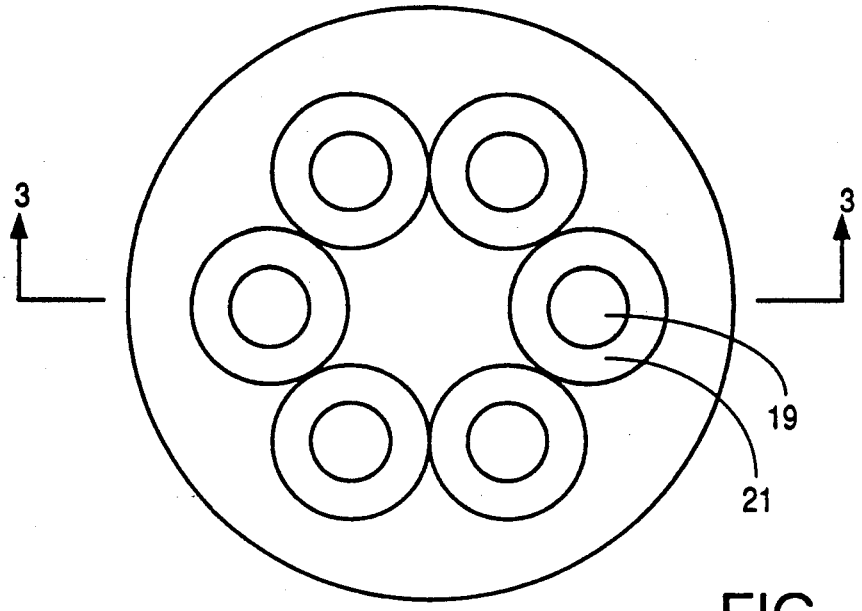
FIG. 2 (PRIOR ART)
FIG. 2 is a schematic top view of a prior art solenoid-actuated rotary sequential actuator for positioning and activating various conductor probes of an RF assembly.
Figure 3:
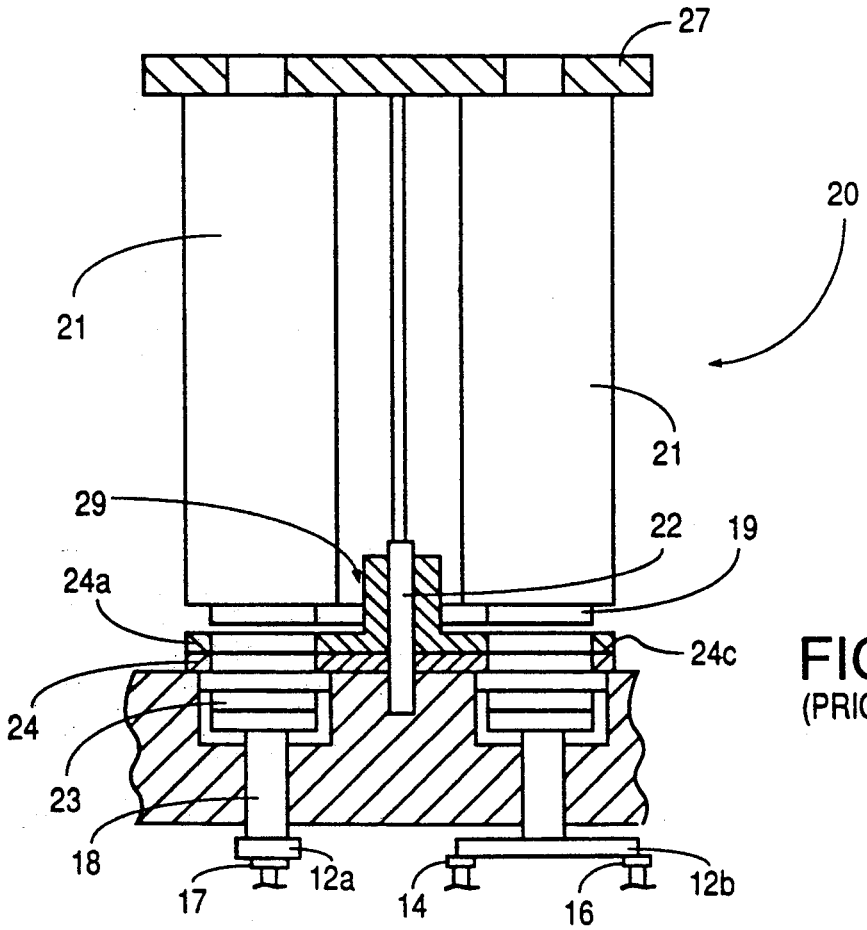
FIG. 3 (PRIOR ART)
FIG. 3 is a schematic cross-sectional side view taken on the line 3—3 thereof.
Figure 4A:
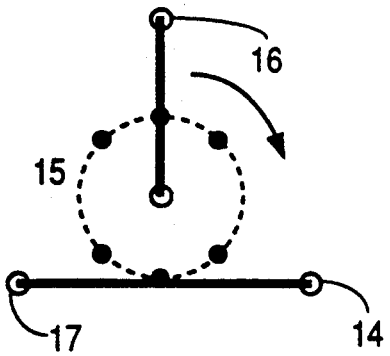
FIG. 4A (PRIOR ART)
FIG. 4A through 4F are diagrammatic illustrations of the sequential positions of the prior art device of FIGS. 1-3.
Figure 4D:
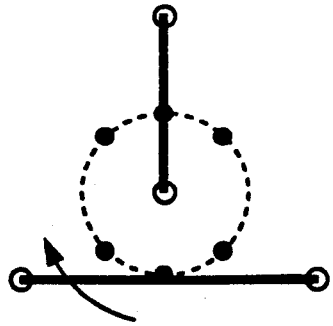
FIG. 4D (PRIOR ART)
Figure 4B:
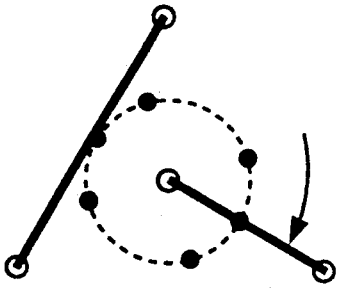
FIG. 4B (PRIOR ART)
Figure 4E:
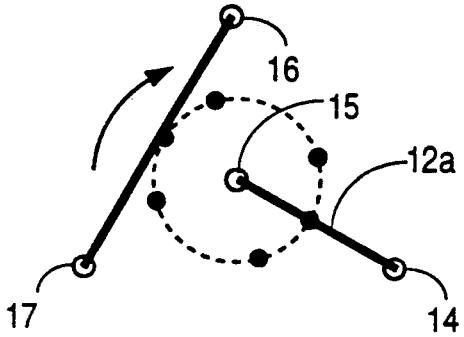
FIG. 4E (PRIOR ART)
Figure 4C:
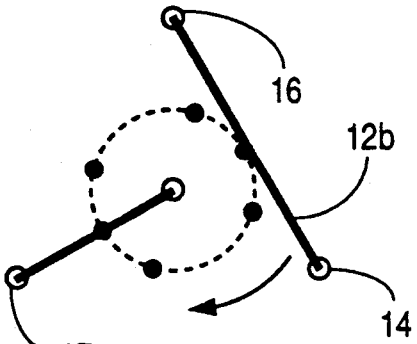
FIG. 4C (PRIOR ART)
Figure 4F:
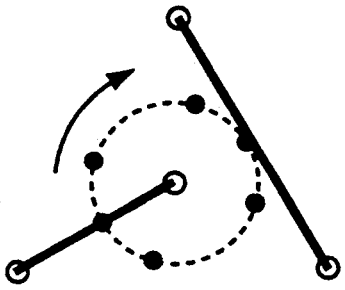
FIG. 4F (PRIOR ART)
Figure 9:
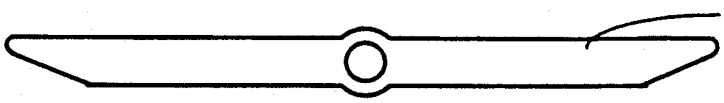
FIG. 9 is a top view of a preferred form of a long-type reed per se.
Figure 10:
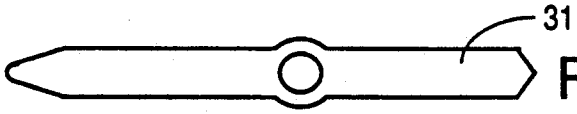
FIG. 10 is a top view of a preferred form of a short-type reed per se.
Figure 11:
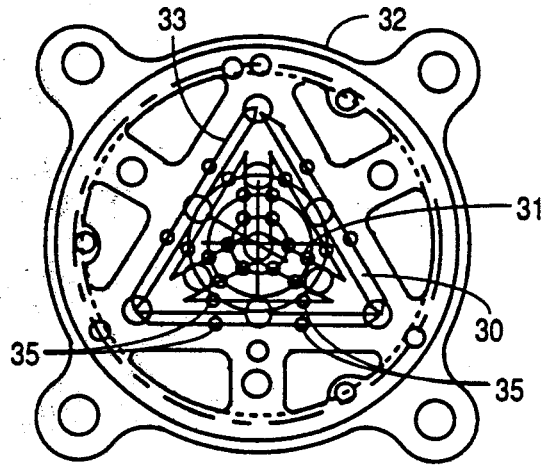
FIG. 11 is a top view of the lower drive body showing the array of microwave contacts
Figure 12:
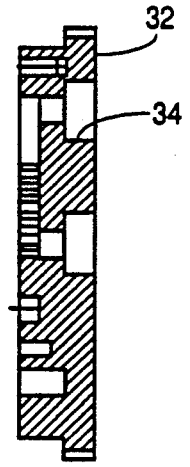
FIG. 12 is a side view thereof.
Figure 13:
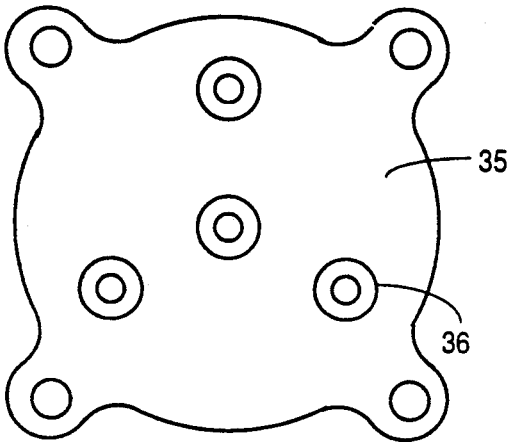
FIG. 13 is a bottom view thereof.

FIGS. 9 and 10 illustrates the " long"reed 30 and "short" reed 31, respectively, used in the invention both of which are constructed of beryllium copper strip alloy 172 per QQ-c-533 condition ¼ H or ½ H, heat treated 38 HRC min. with a gold finish FIG. 11 illustrates the placement of three long reeds 30 and three short reeds 31 in a housing upper body 32 with the reeds in cavities 33 arranged as in FIG. 1. Apertures 35 are provided for insertion of guide pins for assembly purposes and for guiding the reeds in straight up and down movement. FIG. 12 shows bores 34 in the RF lower body which receive the RF connectors. FIG. 13 is the housing lower body 36 constructed, as is the upper body of FIG. 14, of aluminum alloy plate 6061-T6 per QQ-A-250/II finished with bright electroless nickel plate 0.0003–0.004 inch thick per MIL-C-26074, CL4.

Figure 14:
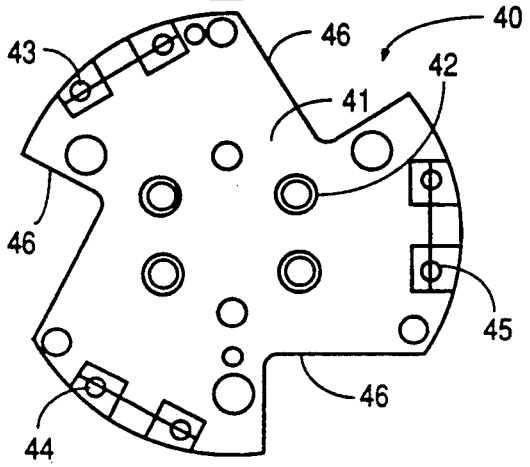
FIG. 14 is a top view of the RF upper body.
Figure 15:
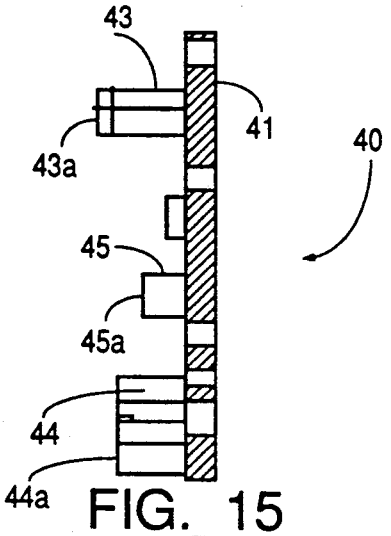
FIG. 15 is a side view thereof.

FIG. 14 shows the top of the RF upper body 41 with holes 42 for reception of the spring-pressed pushrods FIG. 15 shows pedestals 43 and 44 constructed to support the actuator assembly and edge recesses 46. In the center area there are four posts 45 in four places to support the pushrod return spring on the surface 45*a*.

Figure 16:
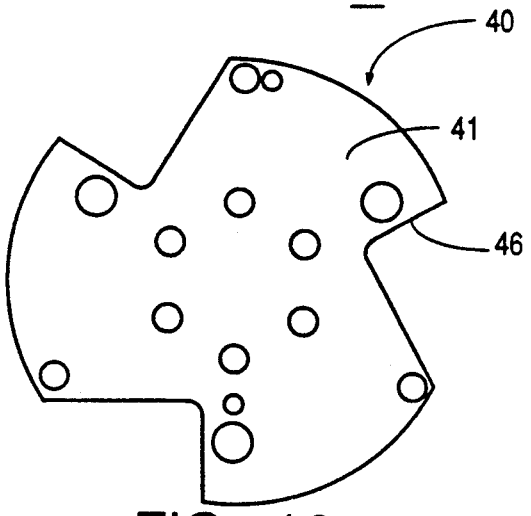
FIG. 16 is a top view thereof.

FIG. 16, a bottom view of the RF upper body, shows the pushrod holes and mounting holes.

Figure 17:
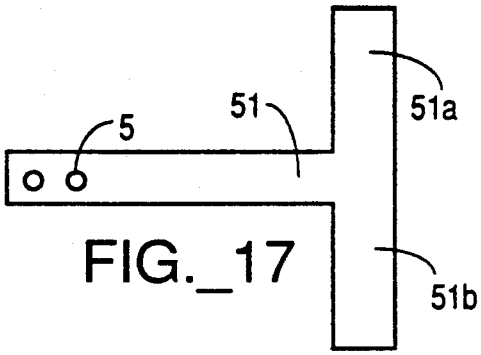
FIG. 17 is a plan view of the actuator/leaf spring of one embodiment of the invention.

FIG. 17 is a detailed view of the leaf spring 5 employed in one embodiment. The leaf spring 51 is T-shaped and includes a cross-piece having spaced end portions 51*a* and 51*b* each of which function when actuated to depress a pushrod 11 and in turn to displace, respectively, a long reed and a short reed. Apertures 51*c* permit passage of screws for cantilever mounting the leaf spring to its appropriate mounting block 52 (FIG. 5).

Figure 18:
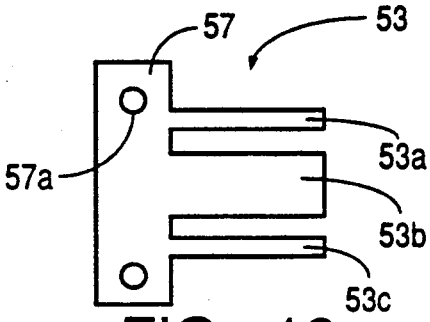
FIG. 18 is a plan view of the dual leaf spring return of the invention.

FIG. 18 is a dual leaf spring 53 in which the outer two of three parallel arms 53*a*, 53*b* and 53*c* provide a spring means for returning the leaf spring 51 from a displaced position to a neutral position not depressing a pushrod. Apertures 57*a* in the dual spring base 57 permit mounting of each actuator leaf spring on a particular pedestal at a different level within the drive body.

Figure 19:
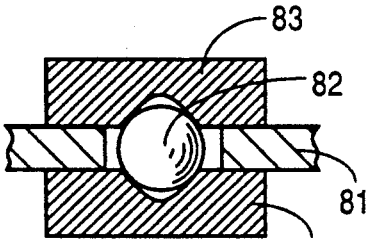
FIG. 19 is a partial cross-sectional view of the ball joint of the T-Switch.

FIG. 19 illustrates the ball joint in which spherical ball 82 permits wobbling or rocking of plate 81. Ball 82 is retained by triangular plate 83 and a bearing plate 89 or by the pusher plate 84 (FIG. 5).

Figure 20:
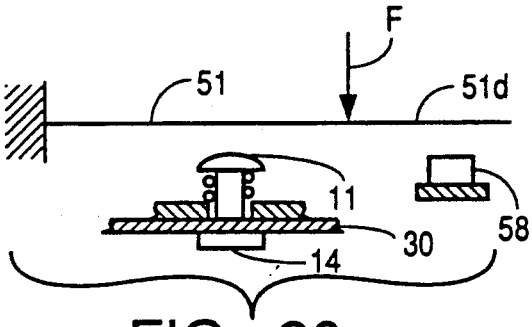
FIG. 20 is a schematic partial cross-sectional view illustrating a force vector engaging the actuator/leaf spring to actuate a pushrod and position indicator contact.

FIG. 20 schematically illustrates the cantilevered leaf spring 51 which when displaced by force F pushes a pushrod 11 and its attached reed 30 to bridge over contact 14 and an associated paired contact. Movement of spring 51 allows an end 51*d* thereof to complete an indicator circuit with a contact 58 to indicate which pair of RF paths in the microwave connector are "closed" due to the rocking action of the wobble plate.

Figure 21A:
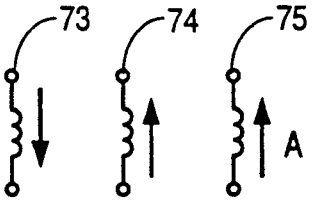
FIG. 21A-21C are diagrammatic illustrations of the direction of current flow in each of three coils in each of three wobble plate angulations.
Figure 21B:
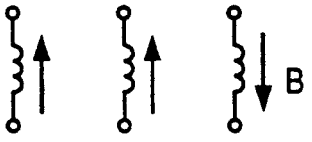
Figure 21C:
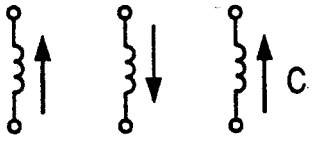

FIGS. 21A, B and C illustrate by arrows the direction of current flow in each of three coils 73, 74 and 75 at three different angular rocked positions A, B and C of the wobble plate, caused by the respective repelling or attraction forces of the particular magnetic coil.

Figure 22:
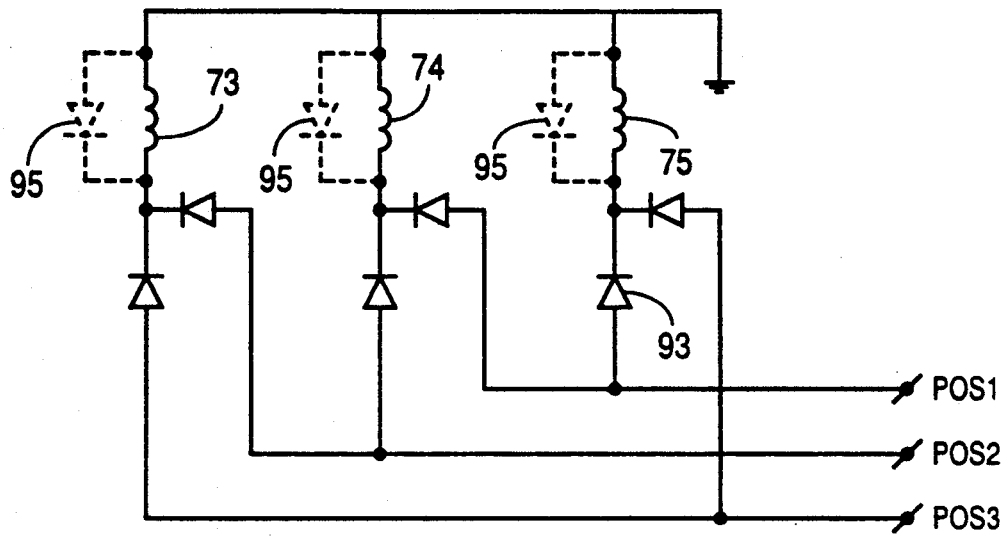
FIG. 22 is a circuit diagram illustrating the control means for wobble plate movement with standard single wound coils.

FIG. 22 is a control circuitry diagram with a "single winding" coil. To switch to a required position a positive voltage pulse is applied to an appropriate terminal. Due to the diodes control circuitry including control diodes 93 and suppression diodes 95, each pulse energizes two of the three coils 73, 74 and 75 to generate attracting forces between the two selected coils and the wobble plate (rocker). These forces between the two cores and two rocker arms attract and pull two of the rocker arms, while the third rocker arm will snap away from its associated unenergized core, forcing down the required actuator assembly.

Figure 23:
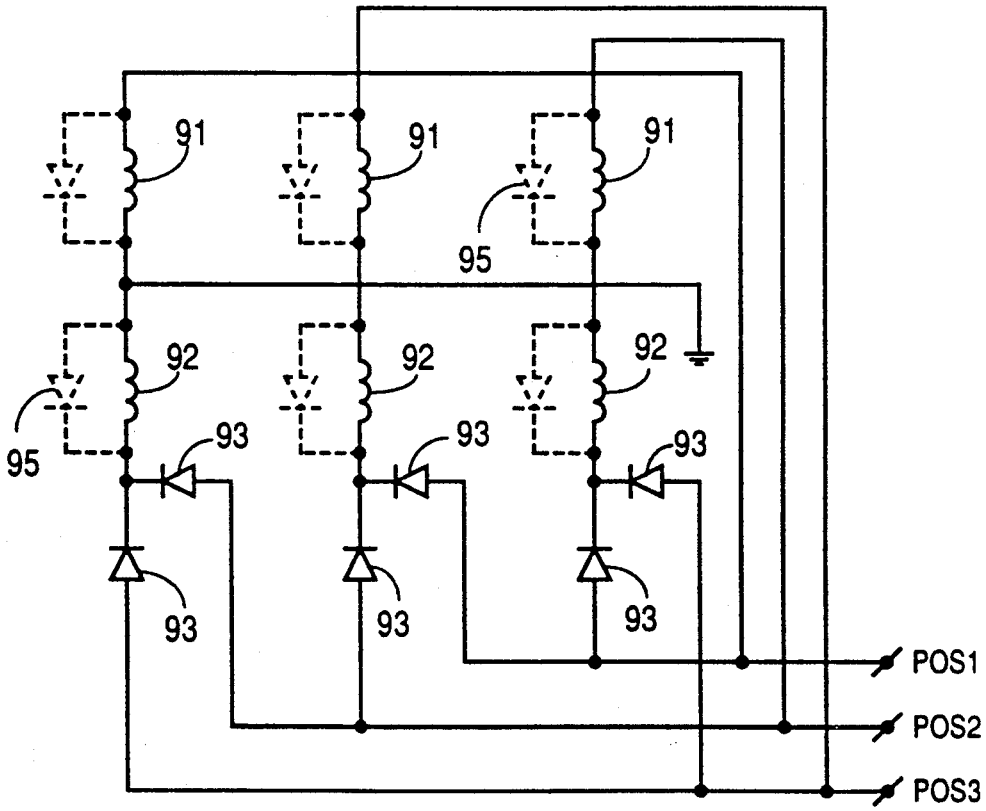
FIG. 23 is a circuit diagram illustrating the control means for wobble plate movement with "double winding" coils.

FIG. 23 is a control circuitry diagram with "double winding" coils. One winding 91 of each coil is used to generate a repelling force between an associated core and rocker arm and the other winding 92 of each coil to generate an attraction force therebetween. The control diode network distributes current applied to one of the input terminals so that two arms of the rocker are attracted and the third arm is repelled.

The above description of embodiments of this invention is intended to be illustrative and not limiting. Other embodiments of this invention will be obvious to those skilled in the art in view of the above disclosure.

I claim:

1. In a microwave switch in which ones of an array of microwave contacts are bridged by a series of connecting conductive reeds in an RF base, the improvement comprising:

a random selection drive for selectively actuating one or more of said series of reeds into electrical contact with selected ones of said array of microwave contacts, said drive comprising a drive body spacedly juxtaposed to and aligned with said base and said series of reeds;

at least two reed actuators mounted with respect to said drive body and at a level relative to said drive body; and means including a single wobble plate and a central ball joint, for mechanically displacing a selected either one or two of said reed actuators such that one or two of said series of reeds are pressed into electrical bridging contact between at lest two of said array of microwave contacts.

2. The switch of claim 1 wherein said at least two reed actuators are angularly spaced from each other and are at a different level relative to said drive body, and in which said wobble plate includes at least two extending pusher arms of different lengths and angularly oriented in alignment with an associated one of said reed actuators; and means for rocking said wobble plate against a selected one of said at least two angularly positioned reed actuators for moving a selected reed into electrical contact with selected ones of said array of contacts.

3. The switch of claim 2 in which said means for rocking comprises at least two angularly spaced electrical coils and a permanent magnetic circuit to repel or retract said wobble plate and thereby move said wobble plate against said selected one of the at least two reed actuators.

4. The switch of claim 3 in which said magnet circuit comprises a flat permanent magnet body mounting said coils, a magnetic core having a first end attached to said magnet body and extending through each coil and a wobble plate base of magnetic material juxtaposed to a second end of each core and being attachable or repelled by one of said coils.

5. The switch of claim 4 further wherein said ball joint extends between said wobble plate base and a bearing plate such that said wobble plate has rocking movement with respect to said drive body.

6. The switch of claim 2 in which said reed actuators comprise three 120° angularly spaced leaf springs, and wherein said means for rocking comprises three magnet coils angularly spaced at 120° from one another for rocking said wobble plate to a selected tilt position, and in which said pusher arms are three in number and are correspondingly 120° spaced from each other and have distal ends for depressing respective ones of said three leaf springs dependent on the actuation of particular ones of said three coils.

7. The switch of claim 6 further comprising control means for energizing one or more of said magnet coils to attract or repel said wobble plate such that a respective pusher arm depresses a desired one of said three leaf springs.

8. The switch of claim 1 in which said reeds are six in number and wherein said reed actuators comprise leaf springs cantilevered from said drive body; and wherein at least three spaced coils are positioned to tilt said wobble plate upon coil actuation for moving a selected one of said leaf springs against a selected number of said series of reeds.

9. The switch of claim 8 in which said wobble plate is angularly movable to one of three positions for selectively actuating any two of said six reeds into bridging contact between two sets of two microwave contacts of said array of microwave contacts.

10. The switch of claim 9 including three of said leaf spring each in a different parallel plane and in which said wobble plate includes three pusher arms, each having a distal end terminating at one of said different parallel planes corresponding to the position of one of said leaf springs.

11. The switch of claim 10 in which said leaf springs include a cross-piece having spaced portions contacting two of said series of reeds.

12. The switch of claim 1 further comprising position-indicating contacts in said drive body; and means for moving a portion of each reed actuator into contact with at least one of said position-indicating contacts to indicate which of said series of reeds has been pressed into contact with which of said array of microwave contacts.

13. The switch of claim 12 in which said actuator portion is a distal end of each said reed actuators and tilt movement of said wobble plate produces a force vector along a longitudinal axis of the reed actuator.

14. The switch of claim 1 wherein said at least two reed actuators comprise three actuators including three leaf springs at different levels in said drive body, said leaf springs being oriented 120° with respect to each other; and further including means for rocking said wobble plate, said means for rocking comprising six magnet coils, two of said coils extending on an iron common core, for repelling or attracting said wobble plate such that the wobble plate is rocked to various angular positions against one or more of said leaf springs.

15. The switch of claim 14 further comprising means for monitoring the angular position of the wobble plate and hence which of said microwave contacts have been bridged by ones of said series of reeds.

16. The switch of claim 14 further comprising means associated with said wobble plate for adjusting the angularity of said wobble plate.

17. The switch of claim 1 further including spring means for returning said reed actuators from a displaced position to a neutral position.

18. The switch of claim 1 wherein said drive body includes at least two pedestals of different heights, wherein said at least two reed actuators comprises a series of reed actuators each being cantilevered from respective ones of said pedestals at different heights and in different levels respectively in said drive body.

19. A microwave switch for connecting selected microwave contacts, said switch comprising:

a base mounting a series of spaced microwave contacts;

a series of conductive reeds spaced above and movable into bridging contact with selected ones of the microwave contacts;

a random selection drive for selectively actuating one or more of said reeds into contact with selected ones of the microwave contacts;

said drive including a drive body juxtaposed to said base and said series of reeds;

at least two reed actuators angularly spaced from each other and positioned at different levels relative to the drive body; and means including a single wobble plate and central ball joint for displacing on a selective basis one of said reed actuator such that one or mores of said series of reeds are pressed into electrical bridging contact between different ones of the microwave contacts.

20. The microwave switch of claim 19 in which each of said reed actuators comprise a leaf spring cantilevered from said drive body and having a depressible portion for depressing a selected one or ones of said series of reeds, and wherein said means for displacing further includes a series of magnet coils and a series of pusher arms, respective ones of said leaf springs being depressible by respective ones of said pusher arms dependent on the actuation of particular ones of said magnet coils.

* * * * *